US005178048A

United States Patent [19]

Matechuk

[11] Patent Number: 5,178,048

[45] Date of Patent: Jan. 12, 1993

[54] MAGNETIC FASTENER RETAINER

[76] Inventor: William Matechuk, Apt. 314 20 Bradman Avenue, St. Catharines, Ontario, Canada, L2M 3S5

[21] Appl. No.: 782,293

[22] Filed: Oct. 24, 1991

[51] Int. Cl.[5] ..... B25B 23/12

[52] U.S. Cl. ..... 81/125; 81/24; 81/44

[58] Field of Search ..... 81/125, 20, 23, 24, 81/44, 451; 227/113; 294/65.5

[56] References Cited

U.S. PATENT DOCUMENTS 29,760 8/1860 Boeklen ..... 81/24

1,127,838 2/1915 Willers ..... 81/44 X 2,671,483 3/1954 Clark ..... 81/24

3,392,767 7/1968 Stillwagon, Jr. ..... 81/125 X 3,707,894 1/1973 Stillwagon, Jr. ..... 81/125

*Primary Examiner*—D. S. Meislin

*Attorney, Agent, or Firm*—McConnell and Fox

[57] ABSTRACT

Fastener drivers are modified by fastening a flexible strap of magnetic material adjacent the driving end of the tool. The fastener is retained on the tool by the magnetic force provided by the strap thus freeing the hands of the user. The strap may be conveniently adapted to a variety of driving tool.

12 Claims, 1 Drawing Sheet

MAGNETIC FASTENER RETAINER

FIELD OF THE INVENTION

This invention relates to means for retaining fasteners on the driving surface of fastener drivers, in particular, hammers, screwdrivers, wrenches.

DESCRIPTION OF THE PRIOR ART

In the past it has been known to use various retainers to hold a fastener in position on the tool when driving the fastener. For example, tack hammers have been magnetized to hold tacks on their face to make tacking more convenient. Screwdrivers have been provided with spring jaws which engage the head of a screw and hold it in proper driving position on the screwdriver. While these retainers have had their uses, they ar of limited value because of their specific application. For example, in the case of a magnetized tack hammer, the whole tool has to be modified to provide the magnetic quality which results in some modification of the tool itself in order to provide the fastener retainer quality. It is also evident that if the tool itself is made out of steel and the steel is magnetized, the use of the hammer or driver in itself will tend to demagnetize the tool since the force of such a magnet deteriorates on impact in most cases.

SUMMARY OF THE INVENTION

In accordance with the present invention, a simple means is provided which may be attached to standard fastener drivers without modification to the standard tool made of magnetically conductive material which provides a retaining force which holds the fastener in a proper relation to the tool and is not deleteriously affected by the operation of the tool. The retaining means consists of a strap of plastic material loaded with magnetized material wrapped around the tool adjacent its operating surface and retained thereon, the magnetic quality of the plastic material being such as to cause magnetic forces a the magnetically conductive operating source of the tool sufficient to retain a fastener made of magnetically conductive material in a proper relationship to the driving surface.

a cleaner understanding of my invention may be had from a consideration of the following description and drawings in which:

Figure 1:
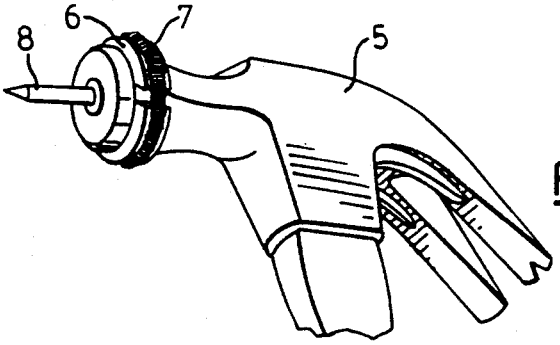
FIG. 1 is a standard carpenter's hammer fitted with a fastener retainer in accordance with my invention.

As will e seen in FIG. 1, a standard carpenter's hammer 5 made of steel has a strap of flexible magnetized plastic material 6 mounted adjacent lists driving face. Suitable plastic strap material loaded with magnetized material will have dimensions of approximately 0.5 cm. by 2 cm. in cross-section. Suitable material having the desirable magnetic and physical qualities is manufactured by the 3M Company and marketed under the tradename Plastiform Magnetic Strip. Depending upon the flexibility of the strap and the curvature required for the application it may be necessary to cut slots in the outer surface of the strap to permit it to bend and conform to the surface of the tool. This strap is held in place by a garter spring 7 which surrounds the plastic strap 6 and holds it firmly about the front portion of the hammer. The magnetic field produced by the strip is sufficient to magnetize the face of the hammer and cause the nail 8, also made of steel, to be retained firmly on the face of the hammer. In use, the operator slips the plastic strap with its garter spring over the head of the hammer and uses the hammer to place the nails and hammer them into position in the normal manner. Because of the strong retaining force of the magnet, the operator can reach remote locations and there is not need for him to use both hands, one to locate the fastener and one to operate the hammer. The result is that the operator can quickly nail material at this maximum reach, for example, when nailing the top edge of drywall or panelling or other situations where it is inconvenient or dangerous to use both hands, one to locate the fastener and the other to operate the hammer.

Figure 2:
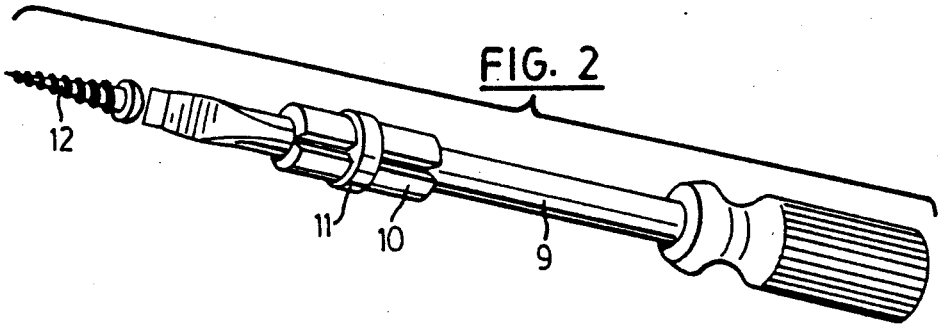
FIG. 2 is a screwdriver fitted with a retainer in accordance with my invention.

FIG. 2 illustrates the application of the fastener retainer to a standard steel screwdriver 9. here the fastener retainer plastic strap is of smaller diameter to fit the shaft of the screwdriver and is designated 10. The retaining means may be simpler in this case since the screwdriver is not subject to impact and a simple stretchable elastic band 11 is sufficient to hold the plastic strap around the shaft of the screwdriver. The fastener steel screw 12, may be laced on the blade of the screwdriver and is retained there while the user can reach into remote locations not available to his hands. It will be seen that the screwdriver can also be used for removing objects, such as steel screws and other magnetic material, which have been dropped and are inconvenient to reach otherwise.

Figure 3:
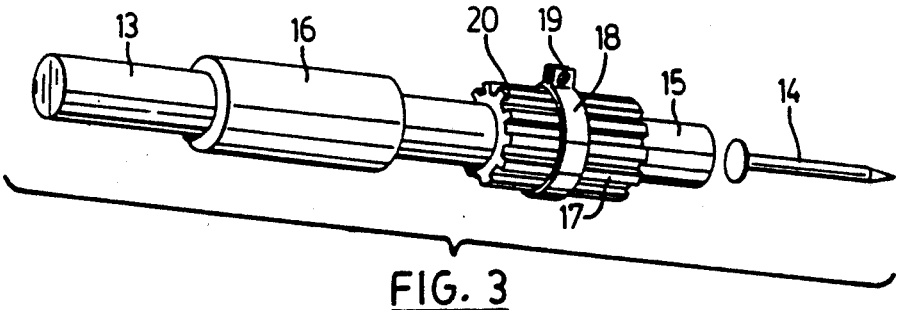
FIG. 3 is concrete nail driving punch fitted with a retainer in accordance with my invention.

In FIG. 3 there is shown a concrete nail punch used for setting steel concrete nails such as nail 14. The punch consists of a hard steel shaft 15 with a handle for gripping by the operator, designated 16. The fasteners retainer 17 is retained in place by a compression clamp 18 with an adjusting screw 19. It will e seen that the plastic strap in this case, as has been previously suggested, has been provided with striations 20 or slots which permit the strap to be mare easily bent around to conform to the source of the steel shaft. Because of the heavier application of this fastener retainer, the strip may have to be thicker and longer than some other applications and the means of retaining it is in place must be more rugged, hence the clamp 18 which is stronger than the previous retaining means.

Figure 4:
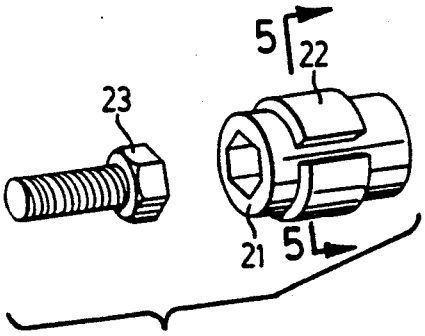
FIG. 4 is a socket wrench fitted with a retainer in accordance with my invention.
Figure 5:
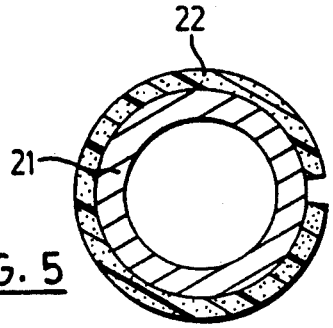
FIG. 5 is a sectional view of the retainer in FIG. 4 at section 5—5.

FIG. 4 illustrates the application of the invention to a socket for driving steel bolts or nuts. A plastic strap 22 is wrapped around the socket 21. This plastic material is provided with an adhesive coating which is peelable which permits a portion of the strap to be wrapped around any smooth tool such as a socket and removed after use and reused in other locations. Because of the minimal impact and stress applied to the retainer, an adhesive is sufficient in this application to maintain the strap in place on the tool. In operation, the operator takes a strip of the adhesive magnetic plastic an sticks it around the end of the socket, places the bolt 23 into the socket where it is retained by the magnetic force of the strap.

As will be seen, using only a minimal number of forms a fastener retainer has been provided which is applicable to various tool sand locations which is simple and rugged and requires no modification of the tool. A simple form such as that used on the hammer in FIG. 1 may be applied to various tools, such as hatchets, hammers and punches. A smaller form, such as shown in FIG. 2, may be applied to various drivers and simple transferred from tool to tool as the need arises. The more rugged form shown in FIG. 3 is more specific in its design and has intended primarily prior situations where it is subject to high impact. It provides a strong retaining force necessary for the function without changing the metallurgical quality of the punch as has been necessary i the past when attempting to magnetize the punch itself.

While a limited number of retaining mans n shapes have been shown, it is evident that further modifications can e provided within the cope of this invention to adapt the retaining means to other fastener driving means and to retain the plastic strap on the tool.

I claim:

1. In combination a tool for fasteners made of magnetically conductive material where the operative end of the tool is made of magnetically conductive material and an adjustable flexible strap of plastic material loaded with magnetized material is wrapped at least partially around and removeably around the operative end of said tool, and retaining means permitting adjustment of the diameter of the strap, when so wrapped, thus retaining the strap on the said end of the tool.

2. The combination as claimed in claim 1 wherein said retaining means is a garter spring.

3. The combination as claimed in claim 1 wherein said retaining means is an adjustable compression clamp.

4. The combination as claimed in claim 1 wherein said retaining means is a peelable adhesive coating on the surface of said strap.

5. The combination as claimed in claim 2 wherein the tool is a steel headed hammer.

6. The combination as claimed in claim 1 wherein the tool is a steel screwdriver and the retaining means is an elastic band.

7. The combination as claimed in claim 3 wherein the tool is a steel nail punch.

8. The combination as claimed in claim 4 wherein the tool is a steel socket wrench.

9. A magnetic fastener retainer device for use in combination with a tool for driving fasteners, both of which are made of magnetically conductive material, comprising an adjustable flexible strap of plastic material loaded with magnetized material, removeably retained wrapped at least partially around the operative end of said tool, and retaining means to retain said strap wrapped around said end of said tool by adjustment of the diameter of the strap when so wrapped.

10. A device as claimed in claim 9 wherein said retaining means is a garter spring.

11. A device as claimed in claim 9 wherein said retaining means is an adjustable compression clamp.

12. A device as claimed in claim 9 wherein said retaining means comprises a pealable adhesive coating on the surface of said strap.

* * * * *